US009146078B2

(12) United States Patent
Quail

(10) Patent No.: US 9,146,078 B2
(45) Date of Patent: Sep. 29, 2015

(54) ADAPTER FOR COMMUNICATING BETWEEN AN ANTI-PERSONNEL TRAINING DEVICE AND A USER WORN MONITORING DEVICE

(76) Inventor: Jeffrey James Quail, Winnipeg, CA (US)

( * ) Notice: Subject to any disclaimer, the term of this patent is extended or adjusted under 35 U.S.C. 154(b) by 60 days.

(21) Appl. No.: 13/608,381

(22) Filed: Sep. 10, 2012

(65) Prior Publication Data

US 2013/0183639 A1 Jul. 18, 2013

Related U.S. Application Data

(60) Provisional application No. 61/631,924, filed on Jan. 17, 2012.

(51) Int. Cl.
*F41A 33/00* (2006.01)
*F41G 3/26* (2006.01)

(52) U.S. Cl.
CPC ..... *F41G 3/2655* (2013.01); *F41A 33/00* (2013.01)

(58) Field of Classification Search
CPC ..... F41G 1/00; F41A 33/00
USPC ..... 434/11–27
See application file for complete search history.

(56) References Cited

U.S. PATENT DOCUMENTS

| | | | | |
|---|---|---|---|---|
| 4,487,583 | A * | 12/1984 | Brucker et al. | 434/22 |
| 5,074,793 | A | 12/1991 | Hambric et al. | |
| 5,207,579 | A | 5/1993 | Campagnuolo | |
| 5,914,661 | A | 6/1999 | Gross | |
| 7,052,276 | B2 | 5/2006 | Davidsson et al. | |
| 8,016,594 | B2 | 9/2011 | Ferris et al. | |
| 8,616,882 | B2 * | 12/2013 | Chedid et al. | 434/19 |
| 2007/0166667 | A1 * | 7/2007 | Jones et al. | 434/11 |
| 2007/0243504 | A1 * | 10/2007 | Bjorkman et al. | 434/22 |
| 2009/0263765 | A1 * | 10/2009 | Jones et al. | 434/11 |
| 2011/0311949 | A1 * | 12/2011 | Preston et al. | 434/16 |
| 2012/0064492 | A1 * | 3/2012 | Pearce et al. | 434/22 |

* cited by examiner

*Primary Examiner* — Timothy A Musselman
(74) *Attorney, Agent, or Firm* — Ryan W. Dupuis; Kyle R. Satterthwaite; Ade & Company Inc

(57) ABSTRACT

An adapter device for use in a combat training system communicates between an anti-personnel training device and a user monitoring device in a training exercise. The anti-personnel training device may be a simulated improvised explosive device including a trigger and an output arranged to output a simulated attack, for example light and sound representative of an explosion, in response to activation of the trigger. The user monitoring device, for example existing training products, such as the Stressvest™ system, the IR Tactical System™, or the MILES™ system, is worn by a user and includes an input which receives a hit signal indicative of the user being hit and an indicator output arranged to indicate the user has been hit. The adapter device has an input sensor to sense the simulated attack of the anti-personnel training device and a signal output to output a hit signal detectable by the user monitoring device.

16 Claims, 8 Drawing Sheets

ADAPTER FOR COMMUNICATING BETWEEN AN ANTI-PERSONNEL TRAINING DEVICE AND A USER WORN MONITORING DEVICE

This application claims the benefit under 35 U.S.C. 119(e) of U.S. provisional application Ser. No. 61/631,924, filed Jan. 17, 2012.

FIELD OF THE INVENTION

The present invention relates to combat training system including anti-personnel training devices, for example a simulated improvised explosive device, and user monitoring devices, for example vests for detecting light-based signals from simulated weapons which simulate a wearer of the vest being hit, and more particularly the present invention relates to an adaptor device for sensing when an anti-personnel training device has been activated and for outputting a signal detectable by the user monitoring devices to simulate the wearer of the vest being hit when the anti-personnel training device has been activated.

BACKGROUND

There are numerous improvised explosive training devices designed to replicate actual Improvised Explosive Devices (IED). The training devices are similar to real LEDs in appearance and are designed to be activated in the same manner as a real IED. Once activated, a loud rapport is created by using either a pyrotechnic, electrical or compressed gas system. This rapport is designed to simulate the noise of an explosion. This creates a realistic stimulus to assist training students to defend against IED attacks.

Obviously, the environment that real LED's will be encountered are typically war zones or extreme high risk situations for law enforcement, such as active shooter events. As a result, IED's are almost exclusively found in arenas where the intended targets are soldiers or law enforcement officers who are armed with firearms. Trainers have recognized the importance of replicating the acute stress environment of combat in training.

"Research has shown that, for some tasks, normal training procedures (training conducted under normal, non-stress conditions) often do not improve task performance when the task was to be performed under stress conditions (Zakay & Wooler, 1984) These results suggest that, under certain conditions, the transfer of training from classroom conditions to operational conditions may be poor when there are no stress-inclusive simulations or training."—Cannon, J. A. & Salas, E. (1998). Making Decisions Under Stress. In Driskell, James E. & Johnston, Joan H. Stress Exposure Training (pp. 193) Washington, D.C.: American Psychological Association. This understanding has led to the development of several "force on force" training products that create a pain penalty to the student to create stress during training. Unfortunately, the training IED's being utilized in training do not create a pain penalty and as a result, does not create the level of stress required for adequate training.

SUMMARY OF THE INVENTION

According to one aspect of the invention there is provided an adapter device for communicating between an anti-personnel training device and a user monitoring device for combat training in which the anti-personnel training device has a trigger and an output arranged to output a simulated attack in response to activation of the trigger and in which the user monitoring device is arranged to be worn by a user and includes an input arranged to receive a hit signal indicative of the user being hit in a combat training exercise and an indicator output arranged to indicate to the user that the hit signal has been received, the adapter device comprising:

an input sensor arranged to sense the simulated attack output by the anti-personnel training device; and a signal output arranged to output a hit signal detectable by the input of the user monitoring device in response to the input sensor sensing the simulated attack output by the anti-personnel training device.

The present invention will allow prior art training IED's with no pain penalty to be integrated with training systems like the Stressvest™ system which has the ability to create a pain penalty. The Stressvest™ is designed to create a localized shock when the student receives a simulated firearms shot during training. This integration will allow the training IED to activate the Stressvest™ which allows the training IED to now have a pain penalty associated with its activation. It can utilize several different methods of sending the signal. Although the device is primarily designed for systems that utilize a pain penalty, it can also be integrated into systems like MILES gear that does not involve a pain penalty, but provide a record of when the student was hit by the IED.

The device would also allow for the integration into any type of computer based simulator system where an audio signal simulating gun fire or explosion would cause the device to be activated. This is beneficial as most computer based systems are based on a visual cues from a screen. This is limiting as it means the officer responds strictly to a visual cue from a screen. This system would allow the officer to utilize the invention in conjunction with a device like the Stressvest™ system. This allows for a pain penalty in a computer based simulator environment.

The input sensor preferably includes a sound sensor which is arranged to sense an audible event which exceeds a prescribed decibel threshold in which the prescribed decibel threshold is adjustable. The adapter device in this instance may include a housing supporting the input sensor and the signal output thereon and a manually adjustable control supported externally on the housing which is arranged to adjust the prescribed decibel threshold.

The input sensor preferably also includes a vibration sensor which is arranged to sense a vibration which exceeds a prescribed vibration threshold in which the prescribed vibration threshold is adjustable. The adapter device in this instance may also include a manually adjustable control supported externally on the housing which is arranged to adjust the prescribed decibel threshold.

More preferably the input sensor includes both a sound sensor and a vibration sensor in which the controller is operable in a first mode in which only the sound sensor is operable, a second mode in which only the vibration sensor is operable, and a third mode in which both the sound sensor and the vibration sensor are operable such that a hit signal is only output when both thresholds are exceeded. Preferably the operator has the ability to adjust the sensitivity of the device to sound and vibration independently of each other. This will allow the operator to identify specific levels of sounds in combination with vibration to ensure only the desired training device will cause the invention to activate.

The signal output preferably includes a radio frequency transmitter arranged to transmit the hit signal to the user monitoring device as a radio frequency signal. By using radio frequency, it give the ability for the training IED to activate any system without the need to be line of sight. This helps create the reality of IED's causing damage even if they are not line of sight. For example, they can activate through a wall in a building.

Preferably a controller is provided which is also arranged to adjust a radio frequency signal strength output by the transmitter. The controller may take the form of a manually adjustable control supported externally on the housing which is arranged to adjust the radio frequency signal strength output by the transmitter. Accordingly, the operator will preferably have the ability to adjust the strength, type or code of the signal of radio frequency being transmitted by the invention. This will allow the operator to define the distance that the device will be effective. This allows the device to match the kill or danger template of a real device.

The signal output may also include a light source arranged to transmit the hit signal to the user monitoring device as a pulsed light signal. By using light or infra red signals, the training IED will now only activate a specific system if they are line of sight. This allows the training IED to replicate directional devices, such as claymore mines. It also allows for training responses such as shielding from the device and rewards the student by allowing them to block the signal.

When the signal output includes both a radio frequency transmitter and a light source, preferably a controller of the adapter device is operable in a first mode in which only the radio frequency transmitter is operable, a second mode in which only the light source is operable, and a third mode in which both the radio frequency transmitter and the light source are operable.

In preferred embodiments the adapter device includes a housing supporting the input sensor and the signal output thereon and a power supply is received in the housing which is operable independently of the anti-personnel training device. The adapter device thus operates independently of the anti-personnel training device and can be easily used with a variety of existing commercially available anti-personnel training devices simply by locating the adapter device in proximity to the anti-personnel training device.

Alternatively the components of the adapter device may be incorporated integrally as add-on components to an existing commercially available anti-personnel training device such that the input sensor and the signal output of the adapter device are integrally supported within the housing of the anti-personnel training device.

The adapter device may be used in combination with an anti-personnel training device simulating an improvised explosive device in which the trigger of the anti-personnel training device is arranged to detect a prescribed event, for example a proximity sensor, a motion sensor or a trip-wire type device, and the output of the anti-personnel training device is arranged to output the simulated attack in the form of sound representative of an explosion in response to detection of the prescribed event by the trigger. In this instance the input sensor is arranged to sense the sound representative of an explosion which is output by the anti-personnel training device.

The adapter device may also in combination with a user monitoring device comprising an electrical impulse device arranged to be worn by a user and deliver an electrical shock to the user in response to receiving the hit signal from a simulated weapon. The adapter device in this instance generates a hit signal detectable by the user monitoring device for delivering an electrical shock to the user. An example of a user monitoring device of this configuration is commercially available under the trademark name Stressvest™.

Alternatively, the adapter device may be used in combination with a user monitoring device of the type used with a simulated weapon arranged to generate a light-based signal in which the input sensor of the user monitoring device is arranged to detect a light-based signal directed thereon by the simulated weapon to indicate the user being hit. In this instance the signal output of the adapter device is arranged to generate the hit signal in the form of a light-based signal detectable by the input sensor of the user monitoring device as an indication of the user being hit. Examples of user monitoring devices of this configuration are known under the trademark name MILES™.

According to a second aspect of the present invention there is provided a combat training system comprising:

an anti-personnel training device including a trigger and an output arranged to output a simulated attack in response to activation of the trigger;

a user monitoring device arranged to be worn by a user and including an input arranged to receive a hit signal indicative of the user being hit in a combat training exercise and an indicator output arranged to indicate to the user that the hit signal has been received; and an adapter device for communicating between the anti-personnel training device and the user monitoring device, the adapter device comprising:

an input sensor arranged to sense the simulated attack output by the anti-personnel training device; and a signal output arranged to output a hit signal detectable by the input of the user monitoring device in response to the input sensor sensing the simulated attack output by the anti-personnel training device.

In preferred embodiments the adapter device further comprises a housing supporting the input sensor and the signal output thereon and a power supply received in the housing which is operable independently of the anti-personnel training device.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Referring the accompany figures there is illustrated an adapter device 10 for communicating between an anti-personnel training device 12 and a user monitoring device 14. The adapter device will sense the activation of anti-personnel training devices 12, for example improvised explosive training devices, manufactured explosive devices or firearms. However, the adapter device can also be activated by any other defined sound or vibration. The adapter device 10 senses the activation of any anti-personal training device, then transmits a radio frequency, light or infra red signal to a desired receiver of the user monitoring device 14. The user monitoring device can be part of any existing combat training systems or products, such as the Stressvest™ system, IR Tactical System™, MILES™ system, computer based systems or any new system developed in the future.

Figure 1:
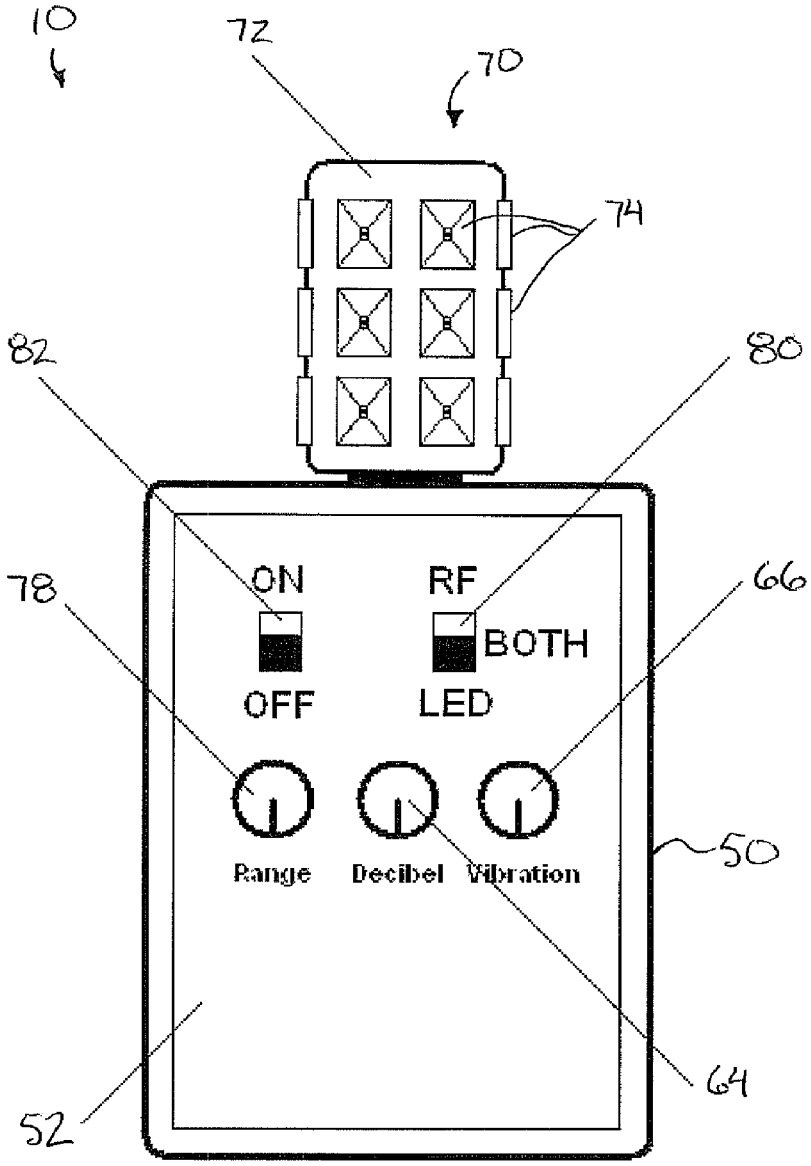
FIG. 1 is a front elevational view of the adapter device.
Figure 2:
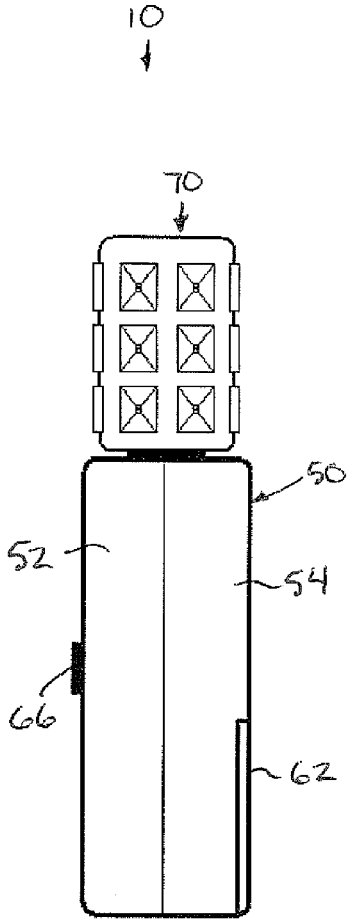
FIG. 2 is a side elevational view of the adapter device.
Figure 3:
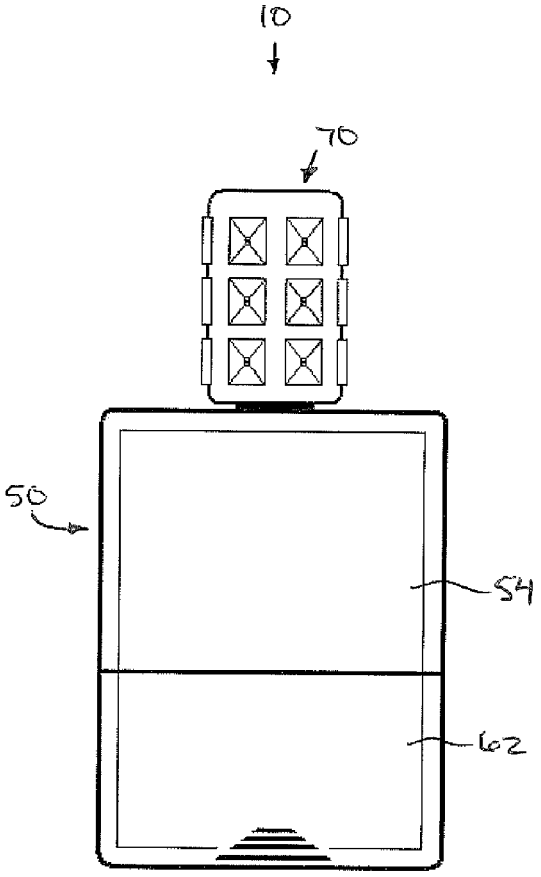
FIG. 3 is a rear elevational view of the adapter device.
Figure 4:
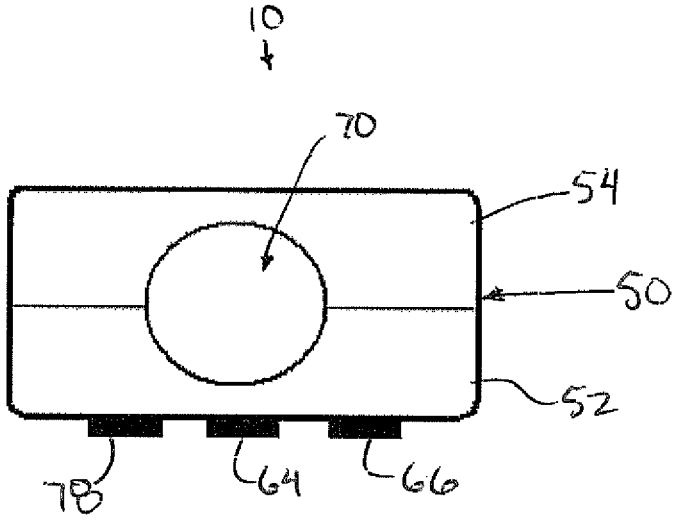
FIG. 4 is a top plan view of the adapter device.
Figure 5:
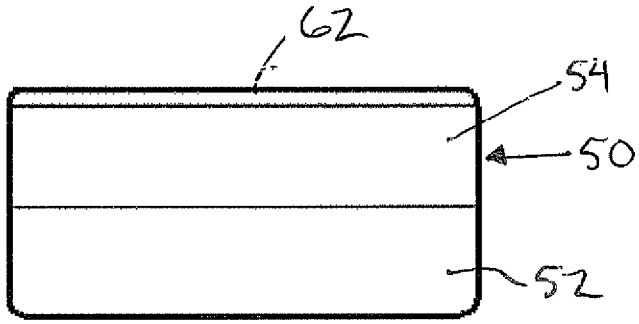
FIG. 5 is a bottom plan view of the adapter device.
Figure 6:
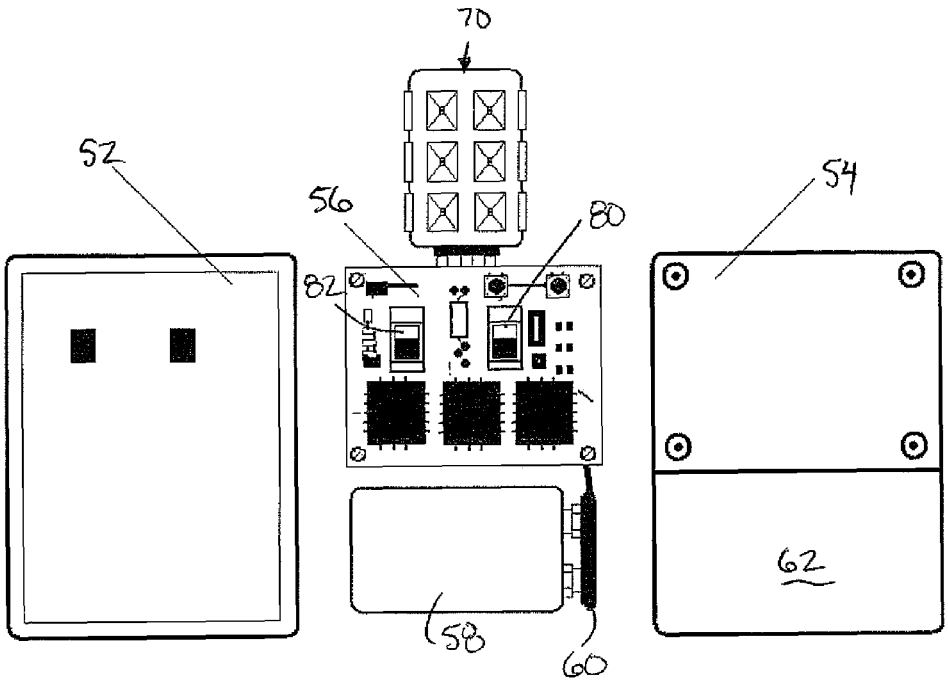
FIG. 6 is an exploded front view of an inner surface of the front and rear portions of the housing of the adapter device and the internal circuitry.
Figure 7:
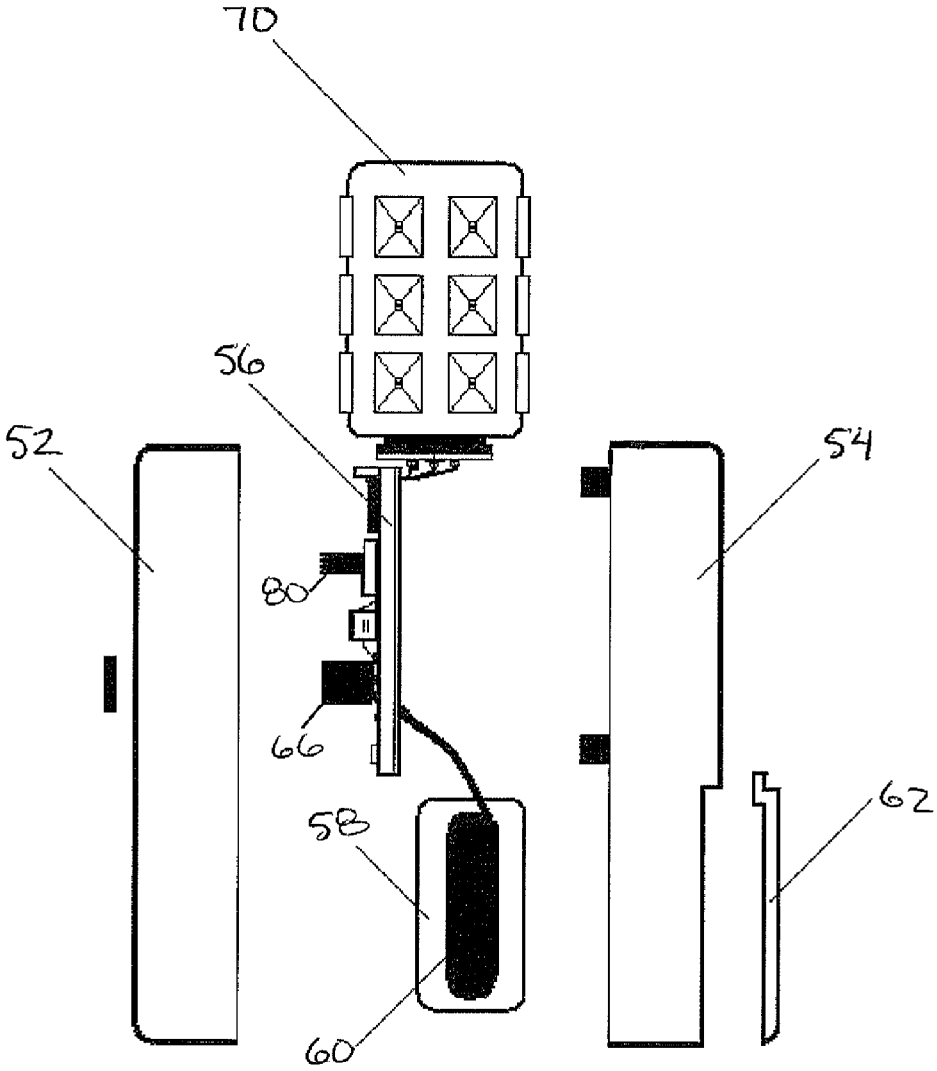
FIG. 7 is an exploded side view of the front and rear portions of the housing of the adapter device and the internal circuitry.
Figure 8:
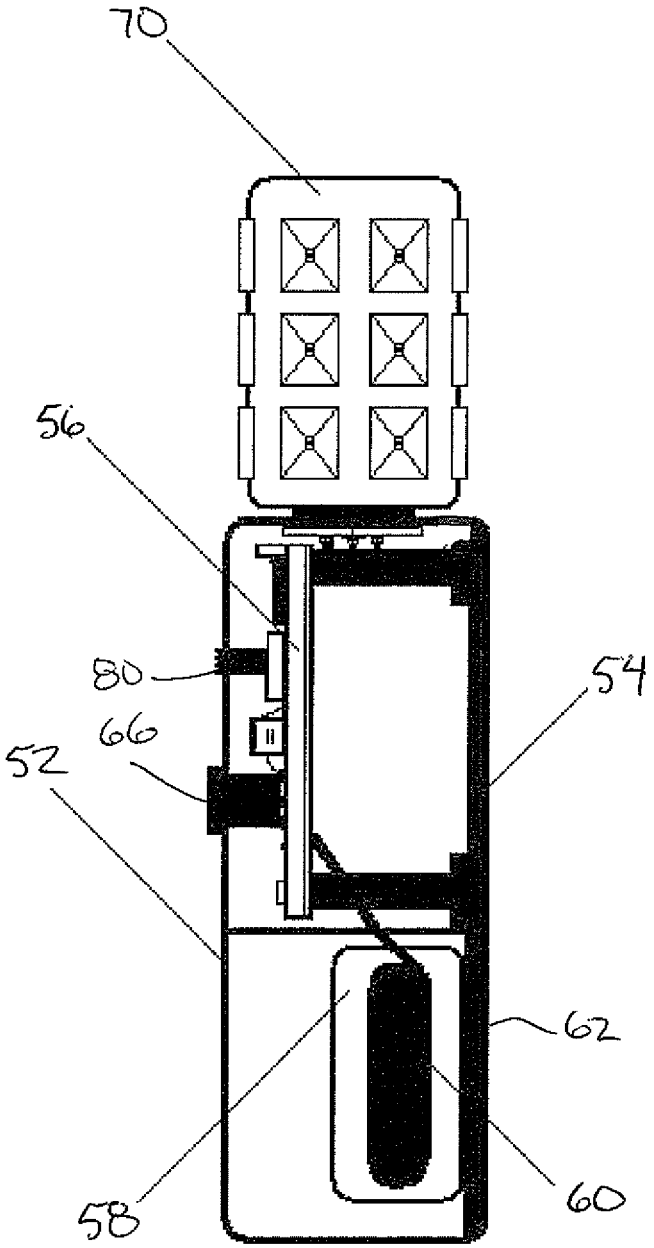
FIG. 8 is a side view of the adapter device with a portion of the housing shown removed.
Figure 9:
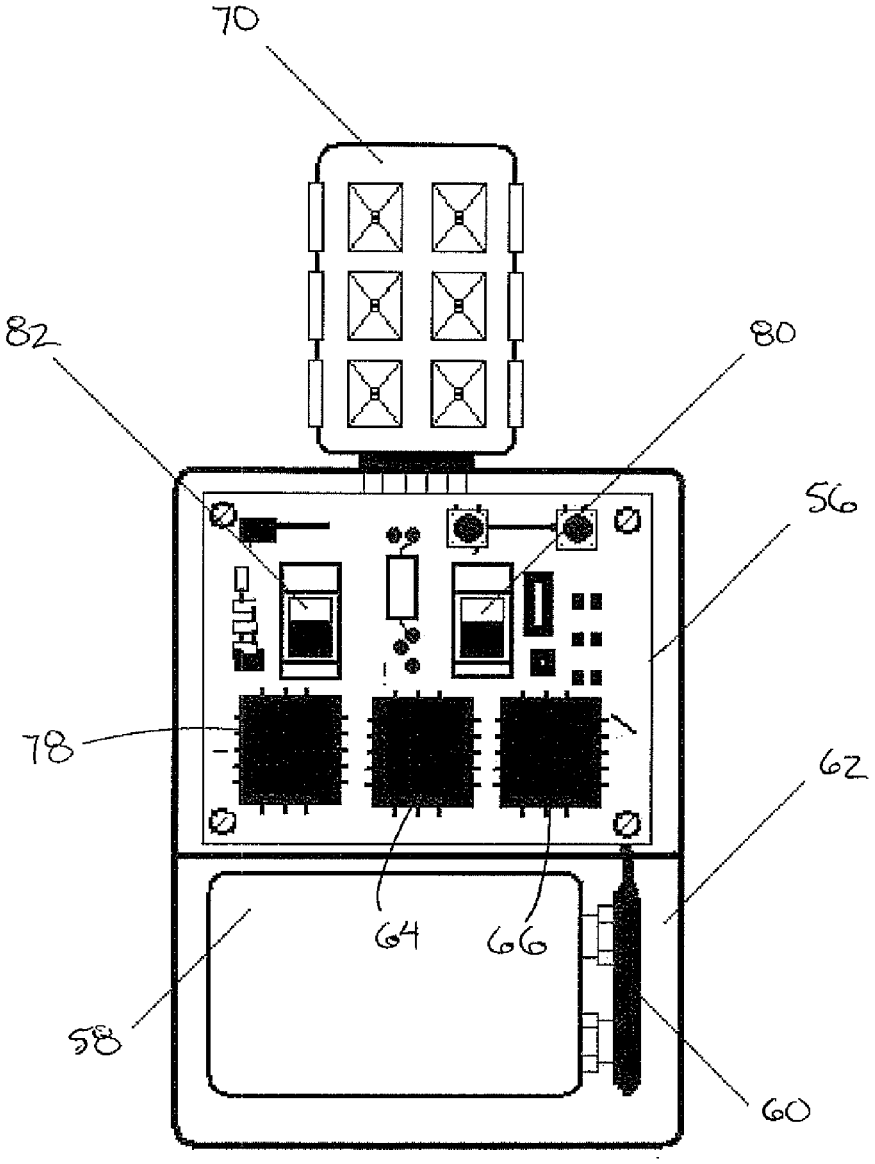
FIG. 9 is a front elevational view of the adapter device with a portion of the housing shown removed.
Figure 10:
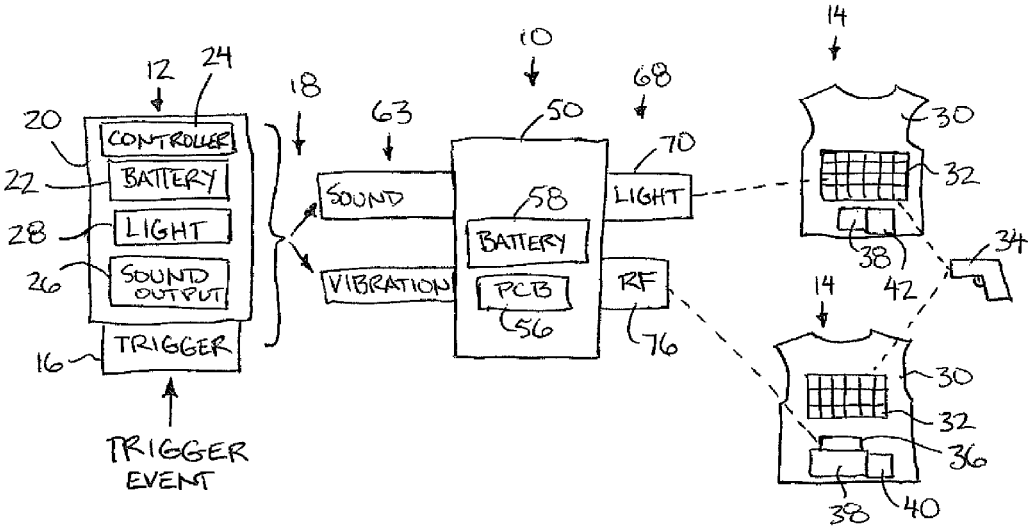
FIG. 10 is a schematic representation of the adapter device in communication between an anti-personnel training device and various types of user monitoring devices for combat training.

One example of an anti-personnel training device 12 for use with the adaptor device 10 of the present invention comprises a simulated improvised explosive device 12 as shown in FIG. 10. The device 12 includes a trigger 16 arranged to sense a prescribed event within a combat training exercise such as the proximity of a trainee to a certain target area. The trigger 16 may thus comprise a proximity sensor, a motion sensor or other similar activation means commonly used for improvised explosive devices including a broken beam-type sensor for example.

The device 12 further includes an output 18 for simulating an attack against trainees in a simulated combat environment. The attack may take the form of various simulated firearms or projectiles, but in the instance of a simulated improvised explosive device, the attack simulates an explosion typically by a combination of light and sound provided electronically or by igniting pyrotechnics for example.

In the instance of an electronic device, the device 12 includes a respective housing 20 locating a battery 22 and controller electronics 24 powered by the battery for controlling operation of the device. The trigger 16 connects to the controller electronics and the controller is in turn connected to the output 18. The output 18 can include a speaker 26 for simulating the sound of the explosion and a light source 28 for visually simulating an explosion by producing an intense flash. The outputs are activated in response to the trigger sensing the prescribed trigger event within the training exercise.

User monitoring devices 14 for which the present invention is suited include various combat training systems. Typically in each instance a supporting body 30 is provided for being worn by a user training within the combat training environment. In the illustrated embodiment of FIG. 10, the supporting body 30 comprises a vest worn about the torso of the user. Each device 14 further includes an input 32 for receiving a hit signal indicating an attack, strike or hit upon the user upon which the monitoring device 14 is supported during the training exercise. The combat training system associated with the monitoring device 14 is typically associated with various simulated weapons 34 arranged to generate the hit signals recorded as a hit or attack upon the user during the training exercise. The configuration of the input 32 and the simulated weapons 34 to the be used therewith will vary between different devices.

In one example of the device 14, the simulated weapon 34 generates a hit signal in the form of a beam of light or a laser in a pulsed or coded format such that the input 32 on the user monitoring device 14 comprises a suitable light based sensor such as an IR sensor or a coded coloured laser sensor for detecting an attack or strike of the coded light pulse from the simulated weapon directed thereon and for decoding the pulse light to determine that the user has been hit.

In some instances, the input further includes a radio frequency receiver 36 arranged to receive hit signals which are transmitted in a radio frequency format from various sources within the combat training environment according to various prescribed conditions encountered by the user during a training exercise. The radio frequency receiver 36 similarly detects and decodes a hit signal to determine if the user has been hit.

In each instance, the user monitoring device 14 further includes an indicator output 38 to indicate that a hit signal has been received and the user has been determined to have been hit within the training exercise by some form of the attack.

According to one embodiment of the user monitoring device 14, the output 38 takes the form of a shock generator 40 arranged to generate and deliver an electrical shock to the wearer of the device in response to a determination that the user has been hit by a simulated attack.

In the alternative embodiment, the indicator output 38 may take the form of a counter 42 for statistically recording attacks to the user. In response to determination of the user being hit, the output 38 in this instance may deactivate a simulated weapon associated with the user or provide other indication to the user in the form of light or sound indicators for example.

The adapter device 10 according to the present invention effectively detects when a simulated attack has been output by the anti-personnel training device 12 and then produces a suitable hit signal detectable by the user monitoring device 14 as an attack upon the user within the simulated combat environment of a training exercise.

More particularly, the device 10 comprises a housing 50 including a front portion 52 and a rear portion 54 spanning respective front and rear sides and being fastened to one another for selectively enclosing a hollow interior of the housing. A printed circuit board 56 is housed within the interior to provide the function of a controller for various aspects of the device. The circuit board is housed within a first compartment of the hollow interior.

A battery 58 is received within a second compartment of the hollow interior and is connected to a battery connector 60 to provide electrical power to the circuit board 56. An access panel 62 is provided in the rear portion of the housing which is selectively removable to provide access for replacing the battery as desired.

The printed circuit board 56 includes an input sensor 63 incorporated therein which may take various forms for detecting when simulated attacks are output from the anti-personnel training device 12 with which the device 10 has been associated. Typically, the input sensor includes a microphone for recording any sound generated by the output 18 of the training device 12 and an accelerometer for detecting any movement, vibration, or change in orientation felt by the housing of the adaptor device 10 as a result of the simulated attack output from the training device 12.

The training device 12 typically outputs sound or vibration within a predictable range such that the printed circuit board can be programmed to detect a corresponding combination of sound and vibration which properly identifies a simulated attack output by the training device 12 as opposed to erroneous vibrations or sounds. The controller of the adaptor device 10 is thus arranged to only determine a simulated attack has been output from the training device 12 if a sound detected is above a prescribed sound threshold programmed into the controller or if vibration detected by accelerometer exceeds a prescribed vibration threshold programmed into the controller.

Alternatively, an attack may only be determined if both the sound and the vibration exceed respective thresholds.

Each of the vibration and sound thresholds are adjustable by respective manually adjustable control knobs 64 and 66 respectively which are supported externally on the housing and connected to the printed circuit board. The controller is thus effectively operable in three modes including i) a first mode in which only the sound threshold must be met, ii) a second mode in which only a vibration threshold must be met, and iii) a third mode in which both a vibration and a sound threshold must be met. The first and second modes are effectively achieved by setting the other threshold value sufficiently low that it is readily met by ambient conditions other than a simulated attack so that the attack is more readily determined if only one threshold is met. More preferably both thresholds are set at appropriate levels only exceeded when a simulated attack has been output by the training device 12 when the adaptor device 10 is placed in close proximity to the training device to minimize erroneous determinations of simulated attacks.

When a simulated attack has been detected, the adaptor device 10 is arranged to output a hit signal of the type detectable by the input 32 of the corresponding user monitoring device 14 with which the adaptor device is being used. The hit signal is output through a signal output 68 of the adaptor device 10. The output 68 includes a light source 70 for emitting light based hit signals comprising coded pulsed beams or lasers in multiple directions from the housing of the adaptor device. The light source in the illustrated embodiment comprises a generally cylindrical body 72 supporting an array of circumferentially and axially spaced LED bulbs 74 thereon for projecting the coated pulsed light in all directions.

The output 68 further includes an RF transmitter 76 arranged to transmit the hit signal in the form of a radio frequency signal at a specified signal strength. The controller in this instance includes a manually adjustable knob 78 supported externally on the housing and in connection with the printed circuit board to permit the signal strength to be specified at a selected strength from a range of signal strengths. By adjusting the signal strength output by the adaptor device 10, the effective range or distance between the adaptor device 10 and user monitoring devices 14 corresponding to the device 14 still being able to detect the hit signal can thus be adjusted. Accordingly a user can effectively simulate different blast radiuses about an improvised explosive device within a training environment for example.

The output 68 of the adaptor device 10 is also effectively operable in three modes. This includes i) a first mode in which the hit signal is output as a light based signal only which is output from the light source 70, ii) a second mode in which the hit signal only comprises a radio frequency signal emitted from the transmitter 76, or iii) a third mode in which the hit signal is output as both a light based signal from the light source 70 and an RF signal from the transmitter 76. A selector switch 80 is supported externally on the housing 50 so as to be manually adjusted between three different positions corresponding to the three modes of operation of the signal output 68 respectively.

The housing also supports a power switch 82 externally thereon which is manually moveable between on and off positions for activating and deactivating electrical power supplied to the controller respectively.

In use, the adaptor device 10 can be used to supplement various forms of anti-personnel training devices 12 such that they are compatible with the user monitoring devices 14 of various combat training systems. Typically, the adaptor device 10 is provided in close proximity to the training device 12 and the thresholds for sound and vibration are adjusted to calibrate the device 10 to be able to detect simulated attacks output by the training device 12 while minimizing erroneous determinations of simulated attacks from the ambient environment.

When the training device 12 comprises a simulated improvised explosive device for example, in addition to simulated light and sound representing an explosion being experienced by the user within a training exercise, the adaptor device 10 detects the simulated attack and produces an appropriate hit signal detectable by the input sensors of the user monitoring devices 14 worn by users within the training environment. The users will be determined to have been hit by the simulated attack if in direct line of sight of the light source of the adaptor device 10 or if within the prescribed range of the RE signal output by the transmitter 76 of the device 10 according to the mode selected on the adaptor device 10.

In further embodiments, the input sensors of the adaptor device 10 may be located remotely from the controller functions of the circuit board and the output components such that input sensors can be located in close proximity to an adaptor device 10 while the output from the housing of the adaptor device 10 can be located at a separate location within the training environment.

Figure 11:
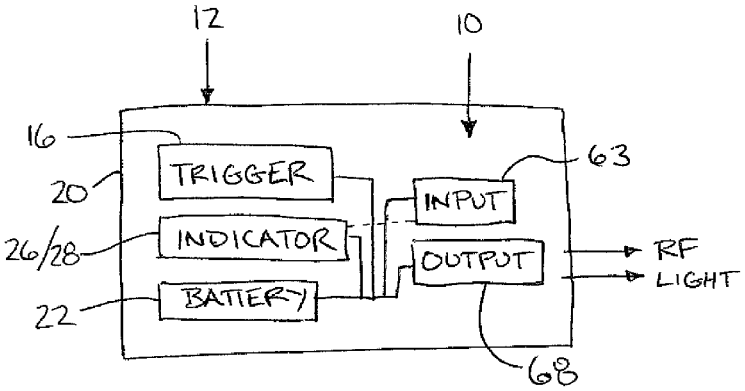
FIG. 11 is a schematic representation of an alternative embodiment of the adapter device in which the adapter device is integrally incorporated into an anti-personnel training device.

In yet further embodiments as shown in FIG. 11, the input and output components of the adaptor device 10 could be incorporated integrally into the housing of an anti-personnel training device 12 such that the input and output of the adaptor device 10 are powered by the existing battery of the training device 12 and the determination of a simulated attack can be accomplished more directly and electronically with the electronic components of the training device 12.

The adapter device 10 as described herein is operable when the battery is connected to the battery connector and the power on switch is turned to the on position. The sensor/transmitter then becomes operational.

The signal will travel to the circuit board that will respond according to the position of the selector switch. When the selector switch is set to Radio Frequency, the device will not only transmit a discreet RF code when it senses the desired sound and vibration. The desired sound and vibration can be selected by adjusting the sensitivity of the decibel sensor in conjunction with adjusting the sensitivity of the vibration sensor.

The effective distance between transmitter and receiver can be varied by adjusting the range dial.

When the selector switch is set to LED, the device will only activate the multi LED bulb. When the selector switch is set to both, both an RF coded signal and flash of the multi LED bulb will occur.

The circuit board will be programmed to identify a specific decibel level and duration or a specific vibration type and duration, or a combination of both decibel and vibration factors. Once the electronic circuitry identifies the desired input, it will send the appropriate response dependent on the selection of the selector switch. The RF and LEDs can be selected specifically for the type of device that is being utilized in training.

In alternative embodiments different materials, sizes and interconnections can be used for all components. A digital display can be added to assist in programming RF codes. The device could also be directly integrated into a computer system for computer generated interactive simulator systems. Instead of buttons and switches, a touch screen application could be utilized and may be imbedded within the display or a separate tablet that communicates through RF or other means. The circuitry could be removed and integrated into an existing structure being used by a product that is need of incorporating our methodology. Furthermore, the method of defining the distance the receiver is from the transmitter can be defined by utilizing algorithms that measure the time that the RF signal is received, versus the time the sound from the rapport of the device hits the receiver. Also, the flash could be a coded light pulse to activate only specific receivers.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An adapter device in combination with a combat training system comprising:

a user monitoring device arranged to be worn by a user and including an input arranged to receive a hit signal indicative of the user being hit in a combat training exercise and an indicator output arranged to indicate to the user that the hit signal has been received; and an anti-personnel training device arranged to simulate an improvised explosive device, the anti-personnel training device including a trigger arranged to sense a proximity of said user to the anti-personnel training device and an output arranged to output a simulated attack comprising sound and vibration representative of an explosion in response to activation of the trigger;

the adapter device being configured to communicate between the anti-personnel training device and the user monitoring device, the adapter device comprising:

an input sensor comprising an accelerometer arranged to sense the vibration output by the anti-personnel training device as a simulated attack representative of an explosion;

a controller arranged to determine an activation condition when a level of the vibration detected by the accelerometer of the input sensor exceeds a prescribed vibration threshold of the controller which is indicative of the simulated attack output by the anti-personnel training device; and a signal output including a radio frequency transmitter arranged to output a radio frequency hit signal detectable by the input of the user monitoring device in response to determination of the activation condition, the radio frequency hit signal having a prescribed signal strength which defines a blast radius of the simulated improvised explosive device such that the radio frequency hit signal is only detectable by the user monitoring device when the user monitoring device is within the defined blast radius of the anti-personnel training device.

2. The combination according to claim 1 wherein the input sensor includes a sound sensor which is arranged to sense an audible event which exceeds a prescribed decibel threshold.

3. The combination according to claim 2 wherein the prescribed decibel threshold is adjustable.

4. The combination according to claim 3 wherein the adapter device further comprises a housing supporting the input sensor and the signal output thereon, and a manually adjustable control supported externally on the housing which is arranged to adjust the prescribed decibel threshold.

5. The combination according to claim 1 wherein the prescribed vibration threshold is adjustable.

6. The combination according to claim 5 wherein the adapter device further comprises a housing supporting the input sensor and the signal output thereon, and a manually adjustable control supported externally on the housing which is arranged to adjust the prescribed decibel threshold.

7. The combination according to claim 1 wherein the controller of the adapter is arranged to controllably adjust the prescribed signal strength output by the transmitter so as to simulate different blast radiuses of the simulated improvised explosive device.

8. The combination according to claim 1 wherein the adapter device further comprises a housing supporting the input sensor and the signal output thereon, and a manually adjustable control supported externally on the housing which is arranged to adjust the prescribed signal strength output by the transmitter.

9. The combination according to claim 1 wherein the signal output includes a light source arranged to transmit the hit signal to the user monitoring device as a pulsed light signal.

10. The combination according to claim 1 wherein the signal output includes a light source arranged to transmit the hit signal to the user monitoring device as a pulsed light signal, the controller being operable in a first mode in which only the radio frequency transmitter is operable, and a second mode in which only the light source is operable.

11. The combination according to claim 1 wherein the adapter device further comprises a housing supporting the input sensor and the signal output thereon and a power supply received in the housing which is operable independently of the anti-personnel training device.

12. The combination according to claim 1 wherein the anti-personnel training device comprises a housing and wherein the input sensor and the signal output of the adapter device are integrally supported within the housing of the anti-personnel training device.

13. The combination according to claim 1 in which the user monitoring device comprises an electrical impulse device arranged to be worn by a user and deliver an electrical shock to the user in response to receiving the hit signal.

14. The combination according to claim 1 in further combination with a simulated weapon arranged to generate a light-based signal, wherein the input of the user monitoring device is further arranged to detect a light-based signal directed thereon by the simulated weapon which is indicative of the user being hit and wherein the signal output of the adapter device is further arranged to generate the hit signal in the form of a light-based signal detectable by the input sensor of the user monitoring device as an indication of the user being hit.

15. The system according to claim 1 wherein the adapter device further comprises a housing supporting the input sensor and the signal output thereon and a power supply received in the housing which is operable independently of the anti-personnel training device.

16. The system according to claim 1 wherein the trigger is selected from the group consisting of a proximity sensor, a motion sensor, and a broken beam type sensor.

* * * * *